US006514040B2

(12) United States Patent
Lewis et al.

(10) Patent No.: US 6,514,040 B2
(45) Date of Patent: Feb. 4, 2003

(54) TURBINE ENGINE DAMPER

(76) Inventors: Thomas M. Lewis, 5994 Rollingsford Dr., Liberty Township, OH (US) 45011; David I. G. Jones, 4687 Kittyhawk, Chandler, AZ (US) 85226

( * ) Notice: Subject to any disclaimer, the term of this patent is extended or adjusted under 35 U.S.C. 154(b) by 0 days.

(21) Appl. No.: 09/755,342

(22) Filed: Feb. 26, 2001

(65) Prior Publication Data

US 2001/0033793 A1 Oct. 25, 2001

Related U.S. Application Data

(60) Provisional application No. 60/174,795, filed on Jan. 6, 2000.

(51) Int. Cl.[7] ..... F01D 25/04

(52) U.S. Cl. ..... 415/119; 416/500; 416/232; 416/190

(58) Field of Search ..... 415/119; 416/500, 416/232, 233, 190, 224, 229 A, 96 A, 96 R, 97 R, 248, 223 R, 241 R

(56) References Cited

U.S. PATENT DOCUMENTS

| | | | | |
|---|---|---|---|---|
| 4,460,314 A | | 7/1984 | Fuller | |
| 4,776,763 A | | 10/1988 | Light | |
| 5,232,344 A | | 8/1993 | El-Aini | |
| 5,407,321 A | * | 4/1995 | Rimkunas et al. | 415/115 |
| 5,584,662 A | * | 12/1996 | Mannava et al. | 416/241 R |
| 5,820,343 A | * | 10/1998 | Kraft et al. | 416/96 A |
| 5,820,348 A | | 10/1998 | Fricke | |
| 5,846,057 A | * | 12/1998 | Ferrigno et al. | 416/241 R |
| 6,155,789 A | * | 12/2000 | Mannava et al. | 416/241 R |
| 6,203,269 B1 | * | 3/2001 | Lorber et al. | 415/115 |
| 6,224,339 B1 | * | 5/2001 | Rhodes et al. | 416/224 |
| 6,224,341 B1 | * | 5/2001 | Fricke | 416/248 |
| 6,238,187 B1 | * | 5/2001 | Dulaney et al. | 416/241 R |
| 6,328,532 B1 | * | 12/2001 | Hahnle | 416/97 R |

OTHER PUBLICATIONS

L.C. Chow and R.J. Pinnington, Practical Industrial Method of Increasing Structural Damping in Machinery, II: Squeeze– Film.

Damping With Liquids, Journal of Sound and Sound Vibration, 1989, pp 333–347, vol. 128 (2).

L.C. Chow and R.J. Pinnington, Practical Industrial Method of Increasing Structural Damping in Machinery, I: Squeeze–Film.

Damping With Air, Journal of Sound and Vibration, 1987, vol. 118 (1).

M.J.H. Fox and P.N. Whitton, The Damping of Structural Vibration by Thin Gas Films, Journal of Sound and Vibration, 1980, pp. 279–295, vol. 73 (2).

D.I.G. Jones and T. Lewis and C. Michael, Partial Coverage Air Film Damping at Cantilever Plates, Journal of Sound and Vibration, 1997, pp. 869–875, vol. 208 (5).

* cited by examiner

*Primary Examiner*—Edward K. Look
*Assistant Examiner*—James M McAleenan

(57) ABSTRACT

A damper that provides damping for turbine engines to reduce vibrations in the blades, vanes, shrouds, ducting, liner walls and/or other components of the turbine engine. The damper includes an air cavity in a blade, vane, shroud or other engine component and a material covering at least a portion of the air cavity. Vibrations in the turbine engine and its components produce movement of the air inside the air cavity resulting in a corresponding viscous force that dampens the vibrations.

12 Claims, 4 Drawing Sheets

TURBINE ENGINE DAMPER

CROSS-REFERENCE TO RELATED APPLICATIONS

This application claims the benefit of the filing date of U.S. provisional application No. 60/174,795 filed Jan. 6, 2000.

GOVERNMENT RIGHTS STATEMENT

The United States Government has rights in this invention pursuant to Contract No. F33615-98-C-3206 awarded by the Department of the Air Force.

FIELD OF INVENTION

This invention relates generally to turbine engines, specifically, to an improved damping mechanism for turbine engine components.

BACKGROUND OF THE INVENTION

A typical turbine engine includes a compressor, a combustor and a turbine. The compressor and turbine each include a number of rows of blades attached to a rotating cylinder often referred to as the shroud. The engine operates by intaking air compressed by the compressor and forcing it into the combustion chamber. During operation of the engine, fuel is continuously sprayed into the combustion chamber along with the compressed air. The mixture of fuel and air is ignited, thereby creating exhaust gases that enter the turbine. The turbine comprises a number of blades that are driven by the exhaust gases produced in the combustor, and since the turbine is connected to the compressor via a shaft, the exhaust gases that drive the turbine also drive the compressor, thereby restarting the ignition and exhaust cycle by drawing further air into the combustor.

The components of the engine operate at very high temperatures and rotational speeds, are subject to large centrifugal forces, and experience high aerodynamic loads, all of which contribute to a high vibration environment. The modes of vibrations in turn significantly stress components of the engine, including but not limited to fan blades, compressor blades, turbine blades, vanes and shrouds resulting in high cycle fatigue and premature wear of the blades and other engine components.

A number of approaches have been used to reduce the vibrations in turbine engines, and specifically, in the blades. One known approach, friction damping, dampens the vibrations in the blades by utilizing a friction damping plate member attached to the underlying blade. As the blades are driven by the exhaust gases, the plate member rubs against the blade and dissipates the vibrational energy. This approach is well-developed, but results in heavy blades, and correspondingly, heavy engines, thereby reducing the efficiency of the engine. Further, the friction damping approach is typically effective over only a limited engine operating speed, because of the required balance between the centrifugal loads on the blades and the friction application forces. Wearing of the plate members and blades is also common because of the friction rubbing action. Friction damping systems consequently have limited life and wear out.

Another known approach is viscoelastic damping. This approach utilizes a layer of viscoelastic material applied to the blade to absorb and dissipate the vibrations. This approach is undesirable because it can increase the weight of the blades and, correspondingly, the blade support structure of the engine, thereby reducing the efficiency of the engine.

Viscoelectric damping also has limited damping performance at high temperatures because the optimal damping range of viscoelastic materials tends to occur for relatively low temperatures. Also, most viscoelastic materials cannot survive the relatively extreme temperature environment associated with the turbine engine. No known viscoelastic material can survive in the turbine section. Further, the viscoelectric materials have short life spans under high centrifugal loads compared to other damping means because of material creep issues associated with viscoelastic materials in the turbine engine environment.

Other vibration dampers utilize hardware attached to the blades, including annular rings, spring members, cross section inserts, wire form members, as well as other mechanical connectors that reduce vibrations in the blades and engine. These dampers add significant weight to engines, tend to be limited in their application to specific engine speeds and vibrational modes, and are subject to wear.

As mentioned, existing approaches to reducing vibrations include significant limitations. Further, the known approaches require much space on, around, or inside the blades. New blade designs such as integrally bladed rotors, as well as the recent trend toward thinner and more aerodynamic blade cross sections, have no installation space for the existing conventional damping systems. As a result, significant improvement can still be made relative to reducing vibrations in turbine engines.

SUMMARY OF THE INVENTION

The object of the present invention is to utilize air film damping techniques to reduce vibrations in turbine engines.

The present invention, an air film damper, utilizes at least one slot or other cavity containing ordinary air or another gas to provide damping to turbine engine components such as blades, vanes, shrouds and ducting/liner walls. Each such cavity can be vented or unvented to the atmosphere external to such component. As a turbine engine structure vibrates for a particular vibration mode in an engine, transverse responses of the upper and lower surfaces of the air cavity do not vibrate equally; instead, relative motion occurs. This relative motion causes movement of the air in the cavity and results in viscous forces that act to oppose the motion of the structure resulting from the vibrational modes.

The specifications of the air cavity in or on a particular component, including its location, area and volume, are dependent on the structural dynamics, and correspondingly the vibrational mode shapes, of the engine component structure upon which it is used; further, the air cavity is not required to be of any standard dimensions or shape, but rather the length, width and depth of the air cavity may vary depending on the structural dynamics to be attenuated. The air cavity specifications are independent of the engine operating temperature and speed.

In one embodiment, the damper uses an air cavity near the surface of a blade, such air cavity being located generally parallel to the axis of the blade which extends radially from the connecting shaft. The damper in this particular embodiment can be formed by milling the air cavity into the blade and covering such air cavity by affixing, typically by welding or metallurgically bonding, a piece of material that either completely or partially covers the air cavity, thereby resulting in an unvented or vented air cavity, respectively. The covering material can be the same material used to fabricate the blade or any other material suitable for covering the air cavity. As described above, when the given resonance of the blade is excited by aerodynamic or rotational forces from turbine engine operation, the blade structure and covering material will vibrate in unequal patterns and a viscous force will be created by the flow of air inside of the damper that will counteract the vibrational modes of the blade. To improve the viscous flow, the vent for the air cavity mentioned above should be relatively small compared to the size of the air cavity.

In another embodiment, the damper can use a slot in the blade in which the air cavity can be formed as either a thin slot through both sides of the blade or a thin slot extending only partially into the blade. If desired, the slot can be covered on either side or both sides with a piece of material affixed to the blade or by bonding material, typically via welding or soldering, directly onto the slot itself. Such material can either completely or partially cover the slot, thereby resulting in either an unvented or vented slot, respectively. The slot provides reduction of vibrations through the viscous air flow previously described.

In some situations it may be of further advantage to provide one or more baffles in the air cavity. The baffles may extend along and connect any two points or sides on or inside the air cavity and can either comprise a solid wall separating portions of the cavity or a simple connector reinforcing the rigidity and structure of the air cavity, but they can also simply extend from any point on the side of the air cavity and terminate within the air cavity. The baffles further act to reduce the vibrations transmitted to the other engine components. The baffles may be formed of the same materials as the engine component or any other suitable material, and may be attached by a variety of bonding techniques including welding, soldering and metallurgical bonding.

In another embodiment, air film damping may be used in connection with stationary elements of a turbine engine such as vanes or ducting/liner walls of the turbine engine. The stationary vanes typically serve to direct the flow of air through the inside of the turbine engine and the ducting/liner walls are the basic skin and structure of the turbine engine. Both the vanes and ducting/liner walls are subject to significant vibrations and in this embodiment one or both contain air cavities. Vibrations are caused as air passes over these components or they are vibrated via mechanical vibrations caused by the operation of the engine and the air cavity acts to dampen the vibrations as described above in the other embodiments.

One advantage of the air film damper is that it adds only negligible weight, if any, to the engine components, and correspondingly, the support structure of the engine, thereby increasing engine efficiency. Another advantage is that the air film damper requires very little, if any, additional space on the engine components or in the engine, thereby enabling more aerodynamic blade profiles and higher engine performance. Another advantage of the air film damper is that it is temperature insensitive and will work equally well at the varying temperatures inside an engine. Another advantage of the air film damper is that the viscous damping medium which provides the damping is air, and air does not burn nor is it susceptible to centrifugal loads. There are no wear issues associated with the air film damper. This results in reduced maintenance of the system. Another advantage of the air film damper is that its damping properties can be operational over a wide range of engine speeds and vibrational modes, thereby increasing its overall effectiveness in reducing vibrations during varying operational conditions. Another advantage of the air film damper is that unlike existing damping technologies it can be used both on moving and stationary parts of a turbine engine.

DETAILED DESCRIPTION

Figure 1:
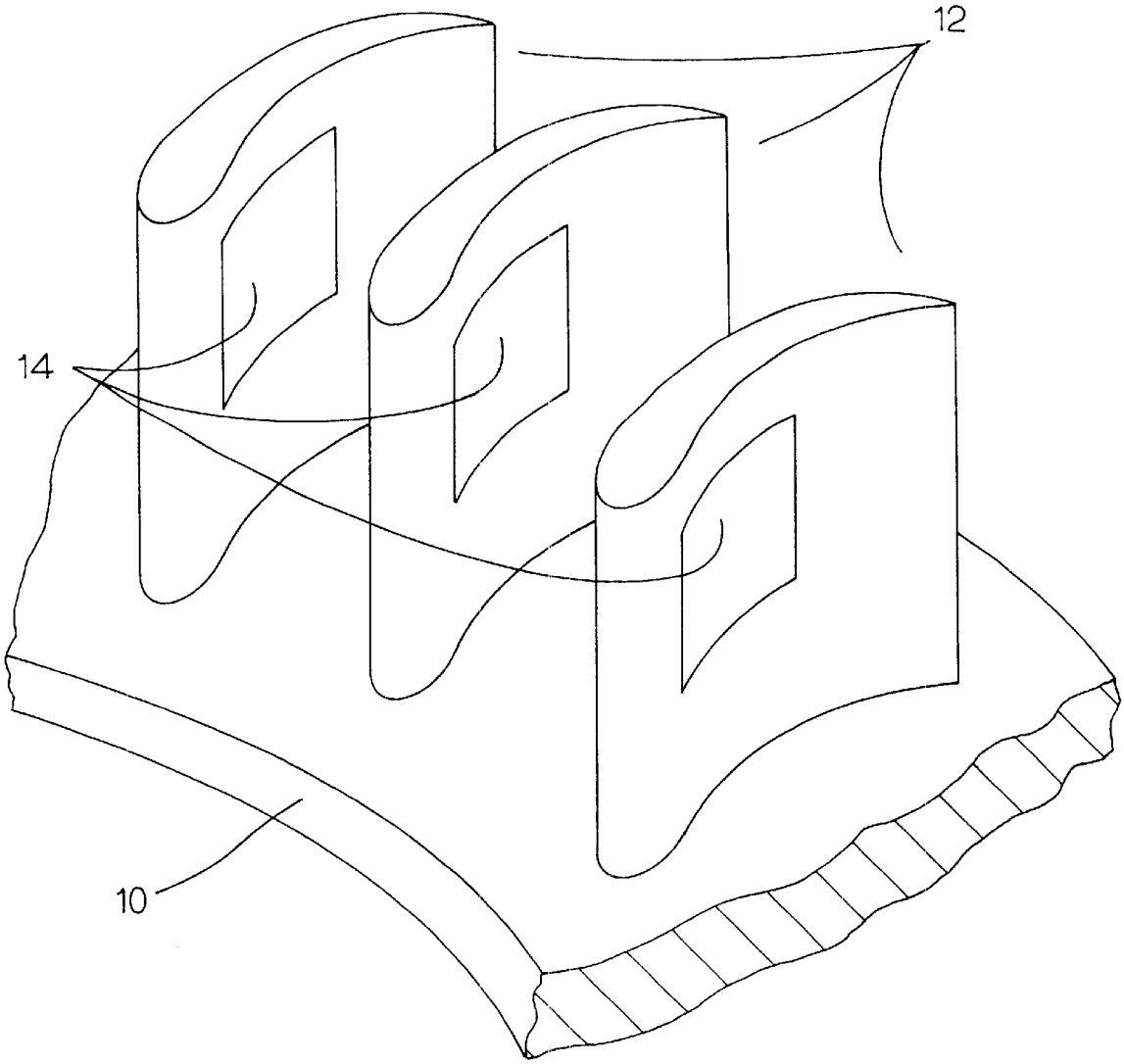
FIG. 1 is an enlarged fragmentary perspective view of an array of blades used in a turbine engine incorporating an air film damper in accordance with one embodiment of the present invention.

FIG. 1 illustrates a fragmentary view of an array of blades (12) attached to a cylindrical shroud (10) that is equilaterally disposed radially around a central shaft. Each blade (12) is depicted with one air film damping structure (14).

Figure 2:
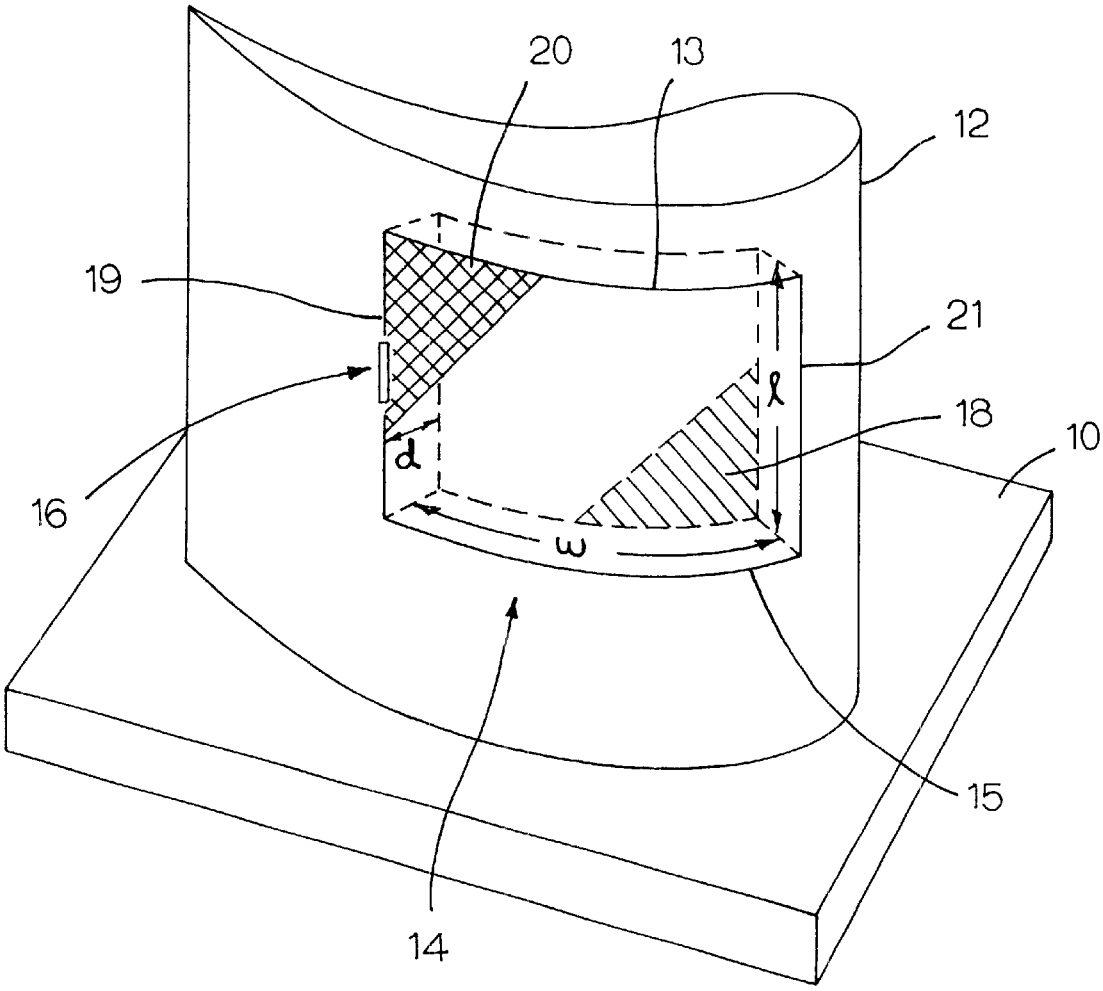
FIG. 2 is an enlarged perspective view of a single blade incorporating an air film damper and depicting the possible placement of an air vent in accordance with one embodiment of the present invention.

FIG. 2 illustrates a single blade (12) attached to a cylindrical shroud (10) showing further detail of the air film damping structure (14). The air film damping structure (14) is comprised of an air cavity in the blade (12) having a length (l) running from the top edge (13) to the bottom edge (15), a width (w) running from the tip edge (19) to the curve edge (21) and a depth (d) running from the inner cavity surface (18) to the outer cavity surface (20). This air film damping structure (14) is also depicted with an air vent (16).

Figure 3:
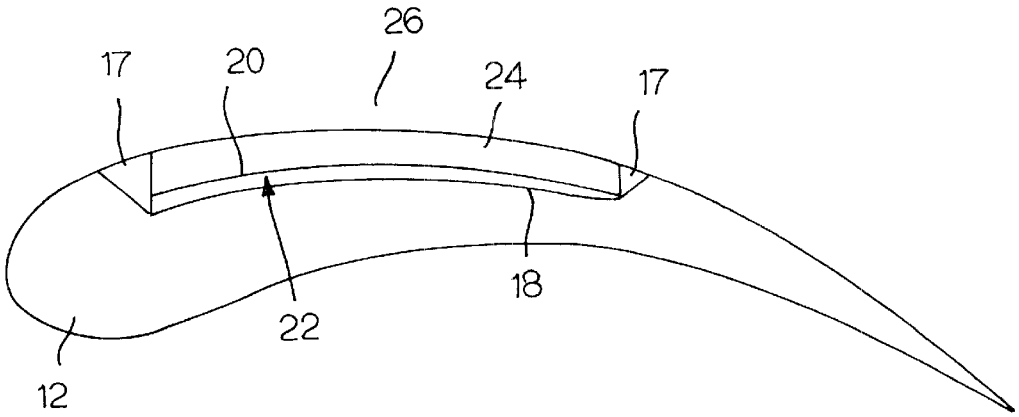
FIG. 3 is a cut-away view along the radial axis of a single blade incorporating an air film damper in accordance with one embodiment of the present invention.

FIG. 3 depicts a cross-section view of the air film damping structure (14) of a blade (12). A portion of the blade (12) is removed, and replaced with a cover (24) with a thickness less than that of the portion of the blade (12) removed to form the air cavity (22). The cover (24) is affixed to the blade (12) by a bonding means (17) between the cover (24) and blade (12). The space between the cover (24) and blade (12) defines an air gap (22). The air gap is specifically defined by the inner gap surface (18) and the outer gap surface (20). Depending on the desired design embodiment, a portion of the welds or metallurgical bonds (17) may be omitted to create a vent between the air gap (22) and outside air (26).

Figure 4:
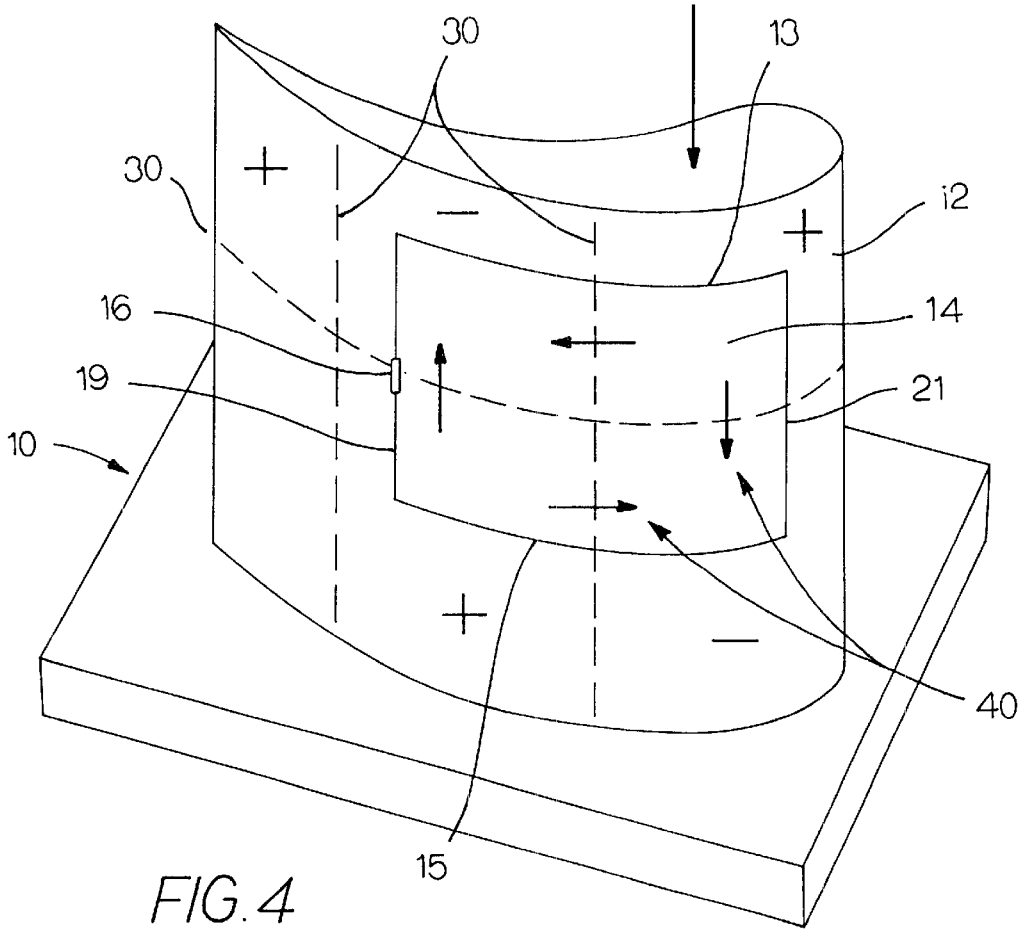
FIG. 4 is an enlarged perspective view of a single blade incorporating an air film damper and depicting the flow of air inside of the air cavity in accordance with one embodiment of the present invention.

FIG. 4 illustrates a conceptual drawing of an air film damping structure (14) attached to a cylindrical shroud (10). As the blade (12) or other components vibrate in a particular mode along various node lines (30), the transverse responses of the inner gap surface and outer gap surface do not vibrate equally and relative transverse motion occurs. This forces the air in the air gap to move inside and/or along the air gap and the resulting viscous forces arising from this motion (40) will tend to oppose the motion of the vibrating blade (12) in that mode.

Figure 5:
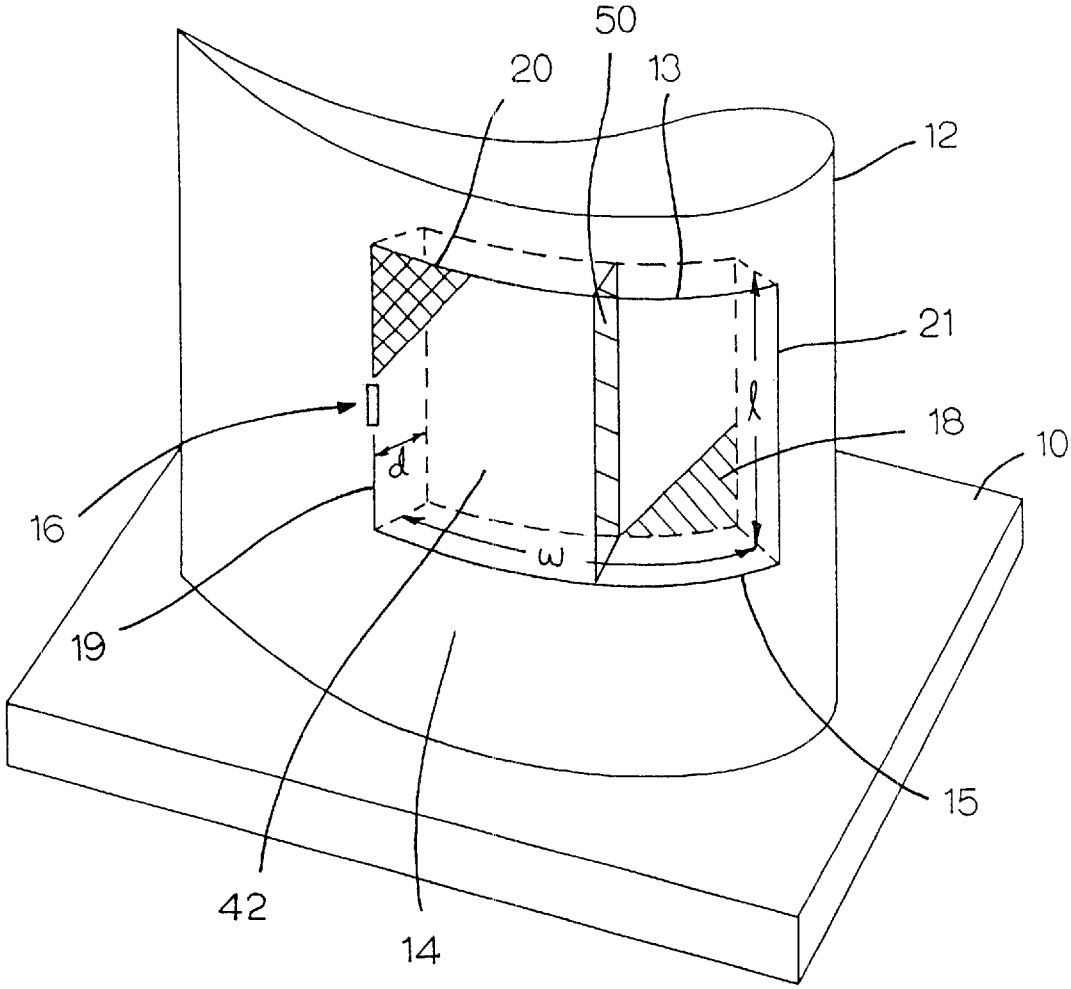
FIG. 5 is an enlarged perspective view of a single blade incorporating an air film damper and baffle.

FIG. 5 illustrates a single blade (12) attached to a cylindrical shroud (10) showing further detail of the air film damping structure (14). The air film damping structure (14) is comprised of an air cavity in the blade (12) having a length (l) running from the top edge (13) to the bottom edge (15), a width (w) running from the tip edge (19) to the curve edge (21) and a depth (d) running from the inner cavity surface (18) to the outer cavity surface (20). This air film damping structure (14) is also depicted with an air vent (16). A baffle (50) is located in the air cavity and extends the length (l) and the depth (d) and operates to separate the air cavity into a tip edge air cavity (42) and a curve edge air cavity (41). Depending on the desired design embodiment, the baffle (50) does not need to extend the entire length (l), width (w) or depth (d) of the air cavity.

The preceding description of the invention has shown and described certain embodiments thereof; however, it is intended by way of illustration and example only and not by way of limitation. Those skilled in the art should understand that various changes, omissions and additions may be made to the invention without departing from the spirit and scope of the invention.

We claim:

1. Dampers for damping vibrations of a turbine engine, each of said dampers being disposed in a component of said turbine engine and said damper comprising a cavity wherein said cavity is disposed within said component and has one or two exterior sides with a material covering at least a portion of said exterior sides of said cavity, wherein said material coverings permit no net flow of exterior gases into said cavity, and wherein said gases in said cavity are the sole damping agent disposed within said walls of said cavity.

2. The damper according to claim 1, in which said component comprises a plurality of blade members, each of said blade members comprised of a root portion and an airfoil portion connected to said root portion, said root portion of said blade members attached to at least one cylindrical shroud.

3. The damper according to claim 1, in which said component comprises at least one stationary vane in said turbine engine.

4. The damper according to claim 1, in which said component comprises a cylindrical shroud, said cylindrical shroud comprising a plurality of blade members, each of said blade members comprised of a root portion and an airfoil portion connected to said root portion, said root portion of said blade members attached to said cylindrical shroud.

5. The damper according to claim 1, in which said component comprises a compressor section of a turbine engine, said compressor section comprising:

a cylindrical shroud, one or more stationary vanes, and a plurality of blade members, each of said blade members comprised of a root portion and an airfoil portion connected to said root portion, said root portion of said blade members attached to said cylindrical shroud.

6. The damper according to claim 1, in which said component comprises a turbine section of a turbine engine, said turbine section comprising:

cylindrical shroud, one or more stationary vanes a plurality of blade members, each of said blade members comprised of a root portion and an airfoil portion connected to said root portion, said root portion of said blade members attached to said cylindrical shroud.

7. The damper according to claim 1, in which said components comprise ducting or liner walls of said turbine engine.

8. The damper according to claim 1, in which said components comprise ducting or liner walls of the exhaust system of said turbine engine.

9. Dampers for damping vibrations of a turbine engine, each of said dampers being disposed in a component of said turbine engine and said damper comprising a cavity in which gases present in said cavity act as the principal damping agent and wherein said cavity is disposed within said component and has one or two exterior sides with a material completely covering said exterior sides of said cavity.

10. The damper according to claim 1 or 9, in which said damper includes one or more baffles inside of said air cavity wherein said baffles are two-dimensional.

11. The damper according to claim 10, in which said baffles extend along the entirety of two of the three dimensions of said air cavity.

12. The damper according to claim 10, in which said baffles extend along the entirety of one of the three dimensions of said air cavity.

* * * * *